US006829858B2

(12) United States Patent
Gablowski

(10) Patent No.: US 6,829,858 B2
(45) Date of Patent: Dec. 14, 2004

(54) GRENADE LAUNCHERS AND METHODS TO SECURE A GRENADE LAUNCHER TO A FIREARM

(75) Inventor: Jürgen Gablowski, Oberndorf (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 0 days.

(21) Appl. No.: 10/351,822

(22) Filed: Jan. 27, 2003

(65) Prior Publication Data

US 2004/0025395 A1 Feb. 12, 2004

Related U.S. Application Data

(63) Continuation of application No. PCT/EP01/08549, filed on Jul. 24, 2001, now abandoned.

(30) Foreign Application Priority Data

Jul. 27, 2000 (DE) ..... 100 36 728

(51) Int. Cl.[7] ..... F41C 27/06
(52) U.S. Cl. ..... 42/105; 42/90; 89/1.41
(58) Field of Search ..... 42/90, 105; 89/1.41

(56) References Cited

U.S. PATENT DOCUMENTS

| | | | | |
|---|---|---|---|---|
| 3,404,477 A | * 10/1968 | Silsby | | 42/105 |
| 4,689,911 A | * 9/1987 | White | | 42/105 |
| 4,733,489 A | * 3/1988 | Kurak | | 42/77 |
| 5,198,600 A | 3/1993 | E'Nama | | 42/90 |
| 5,235,771 A | 8/1993 | Sokol et al. | | 42/105 |
| 5,628,137 A | 5/1997 | Cortese | | 42/105 |
| 5,930,935 A | 8/1999 | Griffin | | 40/105 |
| 6,134,823 A | 10/2000 | Griffin | | 42/105 |
| 2001/0042334 A1 | 11/2001 | Weichert et al. | | 42/105 |

FOREIGN PATENT DOCUMENTS

| | | | |
|---|---|---|---|
| CA | 2246988 A | 3/1999 | |
| IT | 260802 | * 10/1928 | 42/105 |
| WO | WO 0075596 A1 | 12/2000 | |

OTHER PUBLICATIONS

International Search Report for PCT/EP01/08549 (4 sheets).
English Translation of International Preliminary Examination Report for PCT/EP01/08549 (5 sheets).

* cited by examiner

*Primary Examiner*—Stephen M. Johnson
(74) *Attorney, Agent, or Firm*—Grossman & Flight, LLC

(57) ABSTRACT

Grenade launchers and methods to secure a grenade launcher to a firearm are disclosed. In an example method, if the firearm has a first fixed bearing and a first movable bearing separated by a first distance, (a) a first adapter is secured to the grenade launcher, (b) the first fixed bearing is secured to one of the grenade launcher and the first adapter, and (c) the first movable bearing is secured to the first adapter. If the second firearm has a second fixed bearing and a second movable bearing separated by a second distance, (a) a second adapter is secured to the grenade launcher, (b) the second fixed bearing is secured to one of the grenade launcher and the second adapter, and (c) the second movable bearing is secured to the second adapter.

17 Claims, 6 Drawing Sheets

15'
9'
11
7
13
21
19
17
23

GRENADE LAUNCHERS AND METHODS TO SECURE A GRENADE LAUNCHER TO A FIREARM

RELATED APPLICATION

This patent issues from a continuation application which claims priority from International Patent Application Serial No. PCT/EP01/08549 which was filed on Jul. 24, 2001 and is now abandoned.

FIELD OF THE DISCLOSURE

This patent relates generally to firearms, and, more particularly, to grenade launchers and methods to secure a grenade launcher to a firearm.

BACKGROUND

The US grenade launcher M 203 is known. The M 203 is designed to be mounted under the barrel of the Colt M 16 AI rifle. A separate front gunstock or hand guard is assigned to the grenade launcher. This hand guard is attached in place of the original hand guard of the rapid fire rifle (see also German patent DE 35 40 641 C2).

A force-receiving fixed bearing is attached at the gas withdrawal nozzle of the rifle. A force-transferring coupling device of the grenade launcher engages the force-receiving fixed bearing in order to pass its recoil forces into the rifle. A movable bearing is attached close to the reloading device. Thus, the movable bearing is attached behind the fixed bearing. The M 203 grenade launcher is not attachable to a rapid firearm whose design does not agree with that of the above-mentioned M 16 A1.

For example, a shorter version of the M 16 AI rifle has been released. This shorter version of the firearm has a shorter hand guard than the standard model. The shorter hand guard is needed because the force-receiving fixed bearing is closer to the reloading device and, therefore, closer to the movable bearing in the shorter model than in the standard model. The grenade launcher M 203 cannot be attached to the shortened version of the rifle. Moreover, the M 203 grenade launcher may not be easily modified for use with the shortened version of the M 16 because the magazine of the standard version of the rifle serves as handle for actuating the grenade launcher trigger. Therefore, the position of the magazine, and, thus, the reloading device, relative to the grenade launcher cannot be changed.

An intermediate adapter to adapt the M 203 grenade launcher to weapons other than the standard M 16 rifle is not possible because of the associated tolerances. The sighting device of the grenade launcher is attached to the rifle itself, so that the mentioned tolerances between the rifle and the associated sighting device translate into aiming errors.

Similar issues apply to the grenade launcher which is known from U.S. Pat. No. 5,628,137.

DETAILED DESCRIPTION

Figure 1:
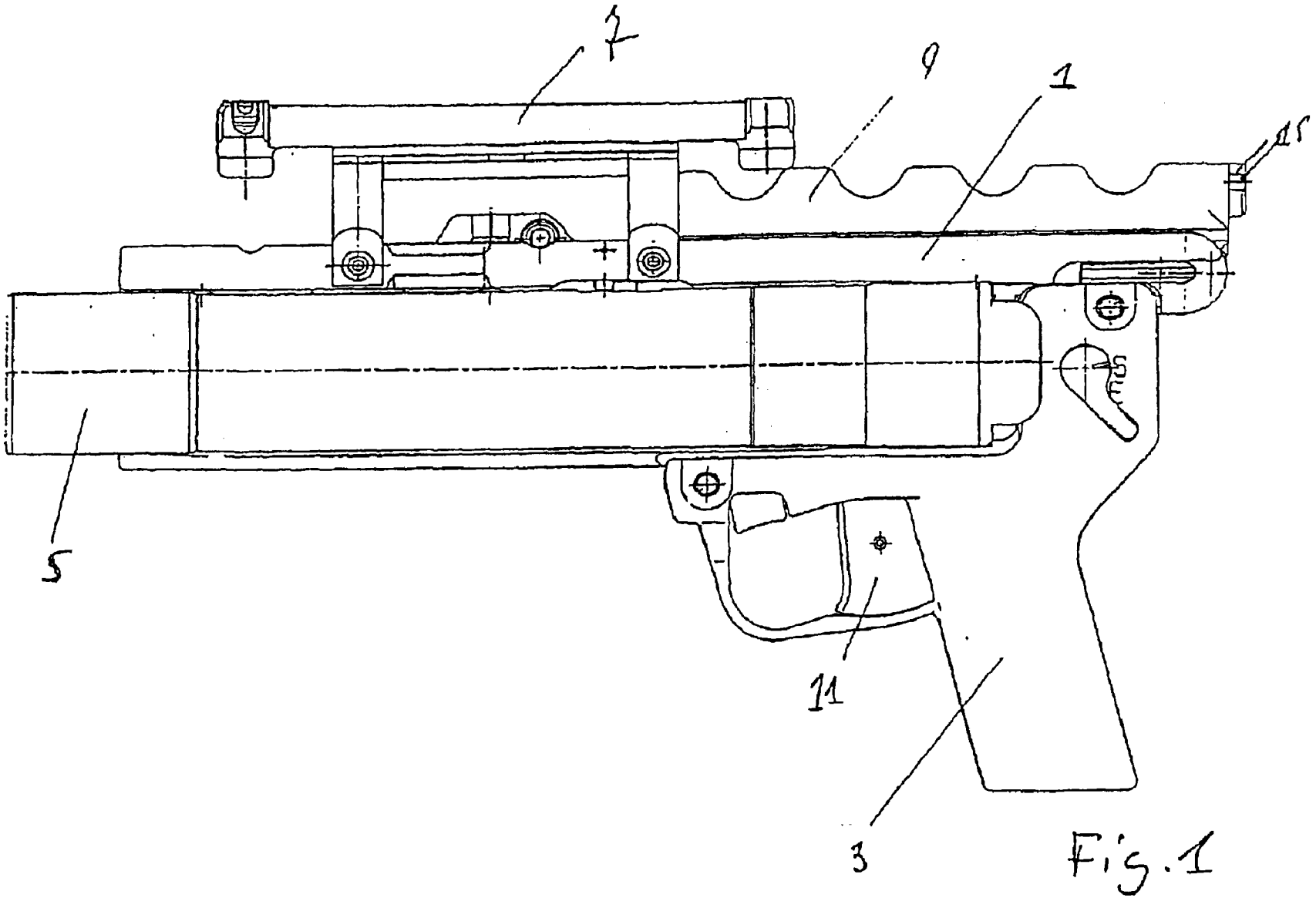
FIG. 1 is a side view of an example grenade launcher with a short adapter.

The example grenade launcher shown in FIG. 1 includes a light alloy housing 1. A handle 3 is attached to the bottom of the housing 1. A cocking trigger 11 is arranged in front of the handle 3. A barrel 5 is swivel mounted to the handle 3. The barrel 5 carries a sighting device 7 and has a short rail 9 mounted on its top. The short rail/adapter 9 has a protruding arrangement at its rear side, which forms a non-force-transferring coupling device 15.

The example adapter 9 shown in FIG. 1 is a short adapter. Thus, the grenade launcher of FIG. 1 is adapted for mounting to a short rapid firearm such as the shortened version of the M 16 rifle.

Figures 2, 3, 4:
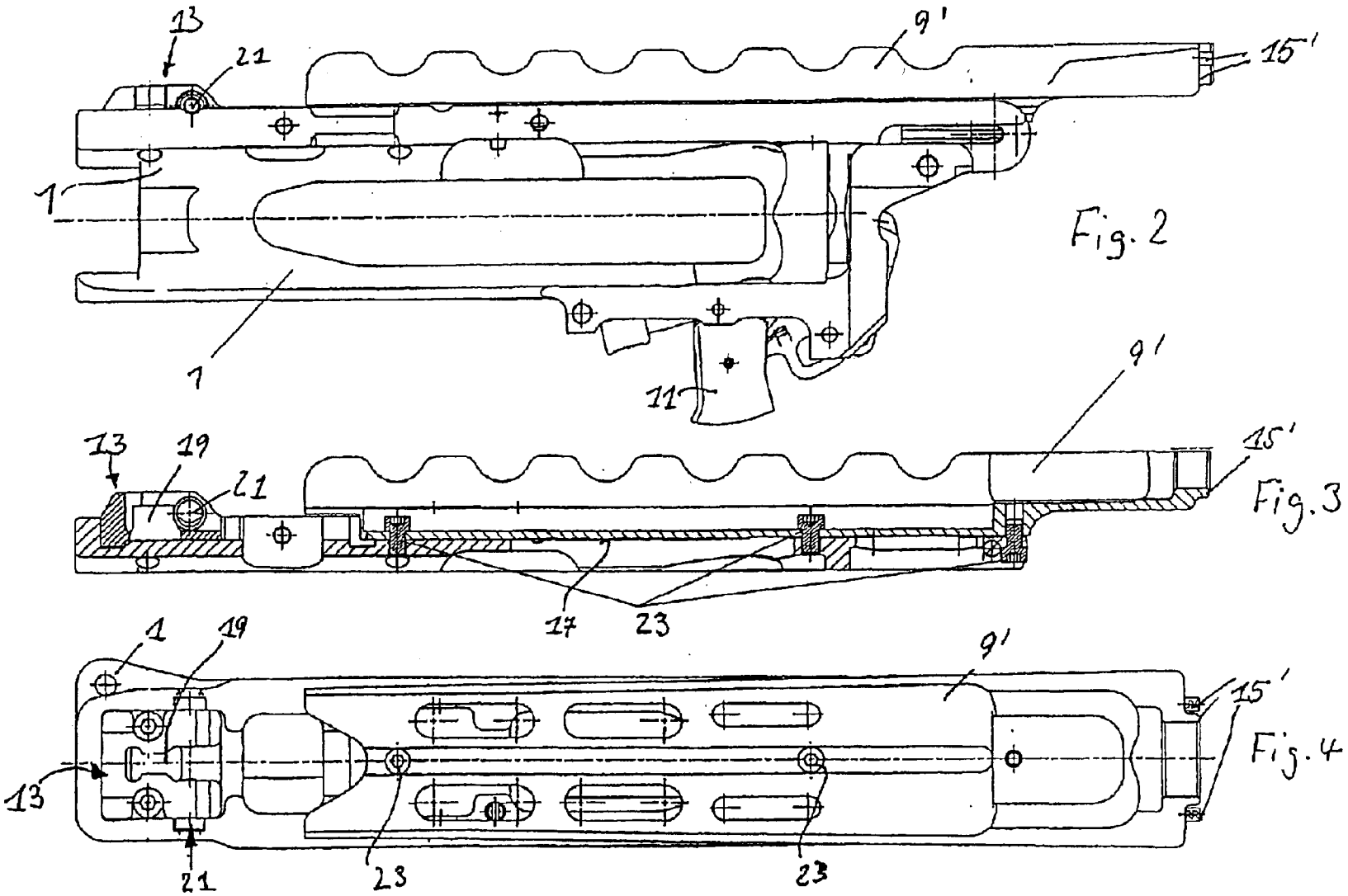
FIG. 2 is a side view of the example grenade launcher housing of FIG. 1, but shown with a long adapter.
FIG. 3 is a cross-sectional view of the top part of the grenade launcher and long adapter of FIG. 2.
FIG. 4 is a top view of the grenade launcher housing and the long adapter of FIG. 2.

The housing 1 of the grenade launcher of FIG. 1 is also shown in FIG. 2. In FIG. 2, however, the barrel 5 and the handle 5 are missing. Only the cocking trigger 11 and a part of the trigger device are shown.

A long adapter 9' is attached to the top of the housing 1 in the example of FIG. 2. The long adapter 9', adapts the grenade launcher for mounting to a rapid firearm of standard length (i.e., not a shortened design). The long adapter 9' of FIG. 2 is substantially similar to the short adapter 9 of FIG. 1, but the long adapter 9' is extended to the rear and exhibits a non-force-transferring coupling device 15'. The distance between the non-force-transferring coupling device 15' and the front of the adapter 9' is larger than the distance between the coupling device 15 and the front of the adapter 9 of FIG. 1. The long adapter 9' of FIG. 2 may be used, for example, to couple the grenade launcher to the standard version of the M 16.

A force-transferring coupling device 13 is located in front of the adapter 9 and/or 9' at the top of the housing 1. The coupling device 13 is cast from steel into the aluminum housing 1 as a composite casting part. A groove 19 is formed in this coupling device 13 (see also FIGS. 3 and 4). This groove 19 is open to the rear. The tops of the side walls of the groove approach each other, so that they form an undercut, in which a hammer-head bolt can be inserted from the rear. This hammer-head bolt (not shown) is attached to the rapid firearm (usually at the part taking up the gas withdrawal channel) and forms its fixed bearing. The hammer-head bolt is inserted into the groove 19 and moved up to the front of the groove 19 until it reaches the stop (i.e., the closed groove end). A transverse running safety lock pin (not shown) is then pushed through a bore 21 to secure the hammer-head bolt in the groove 19.

Both of the adapters 9, 9' include an even shoulder area 17 at their bottom (see FIG. 3). The even shoulder area 17 sits smoothly on a complementary even area of the grenade launcher housing 1. The long adapter 9' is attached to the housing 1 by three simple screws 23 as shown in FIG. 3. The long adapter 9' can, thus, be removed and replaced by, for example, a short adapter 9 (FIGS. 1 and 5).

FIG. 4 is a top view showing that the long adapter 9' extends only over a part of the length of the housing 1. The coupling device 13 remains uncovered. There is plenty of space between the rear edge of the coupling device 13 and the front edge of the adapter 9' to attach the hammer-head bolt (not shown). As also shown in FIG. 4, the rear coupling device 15' includes an arc-shaped fin and two pins. One pin is located on each of the sides of the fin. Each of the pins and the fin fits in corresponding recess(es) of the movable bearing (not shown).

Figure 5:
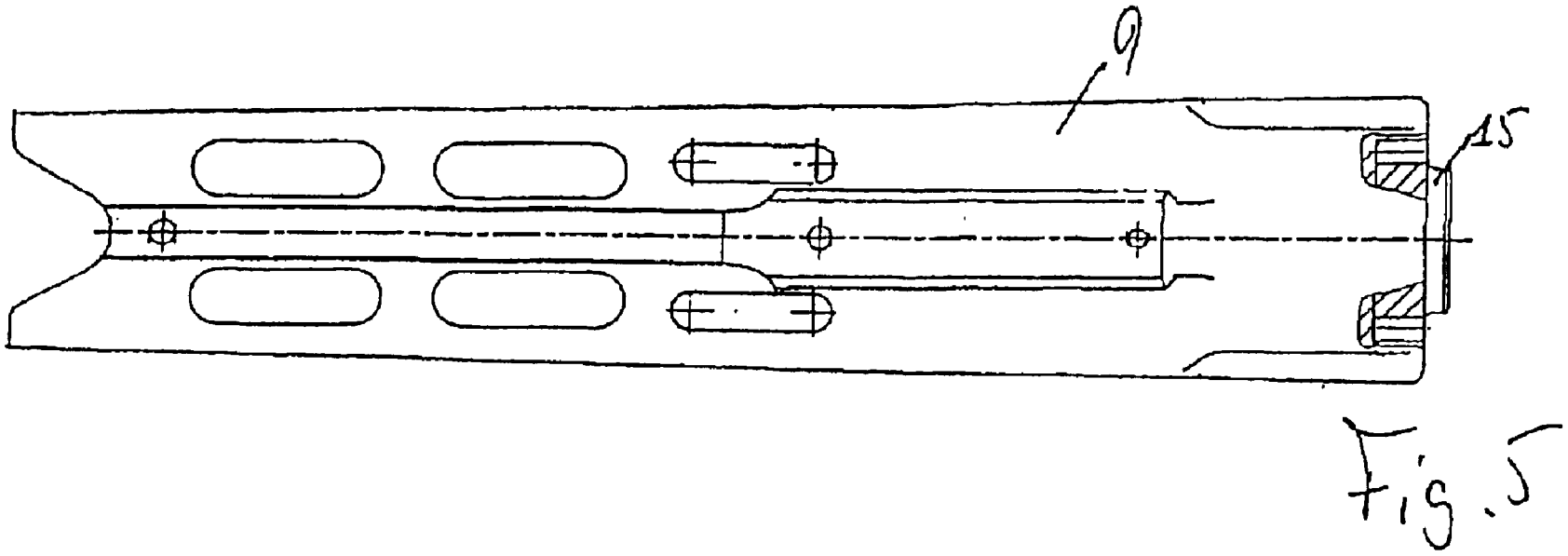
FIG. 5 is a partially cut away, top view of the short adapter of FIG. 1.

FIG. 5 is a top view of the short adapter 9 of FIG. 1 before it is attached to the grenade launcher.

The tops of the adapters 9, 9' are open and trough-shaped, and are complementary to the hand guard or front gun-stock of the rapid firearm, so that the grenade launcher may be secured under the front part of the rifle. If a right-handed shooter desires to shoot the rapid firearm with the grenade launcher attached, then the shooter grips the handle 3 with the left hand. If the same shooter desires to shoot the grenade launcher, then he grips the handle 3 with the right hand.

When attaching the grenade launcher to the rifle, the grenade launcher is held parallel to and pressed from below against the rapid firearm in such a way that the fixed bearing of the rifle (e.g., the hammer-head pin, not shown) drops behind the force-transferring coupling device 13 and in front of the adapter 9, 9' from above. Next, the grenade launcher is pushed rearward in parallel to the rapid firearm (its hand guard serves as a guide for the adapter 9, 9'). This rearward movement causes the hammer-head bolt of the rifle to run into the groove 19 until it abuts the front wall of the same. Is also causes the semicircular fin and the pins 15, 15' to run into the movable bearing of the rifle. Finally a safety lock pin is inserted into the bore 21. The grenade launcher is now firmly attached to the associated rifle.

Figure 6:
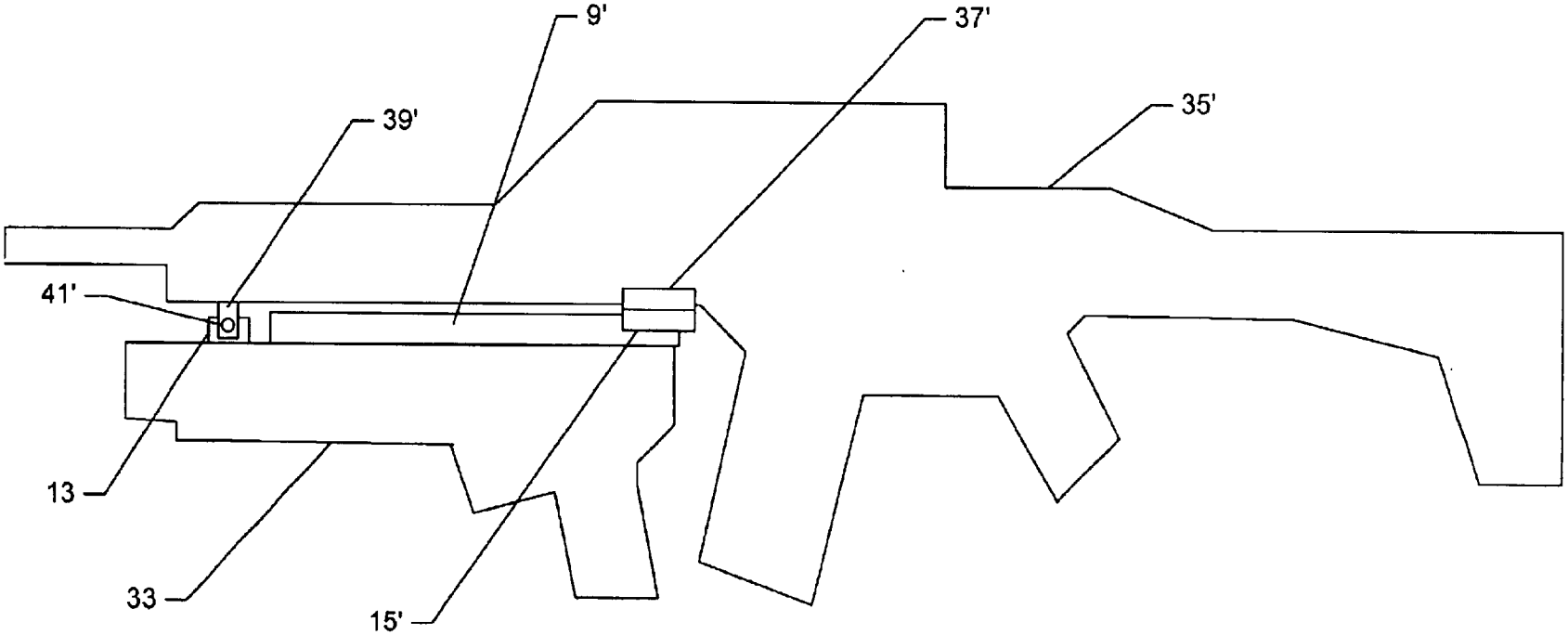
FIG. 6 illustrates a first example weapon system that includes a first example grenade launcher coupled to a first example firearm using a first example adapter disclosed herein.
Figure 7:
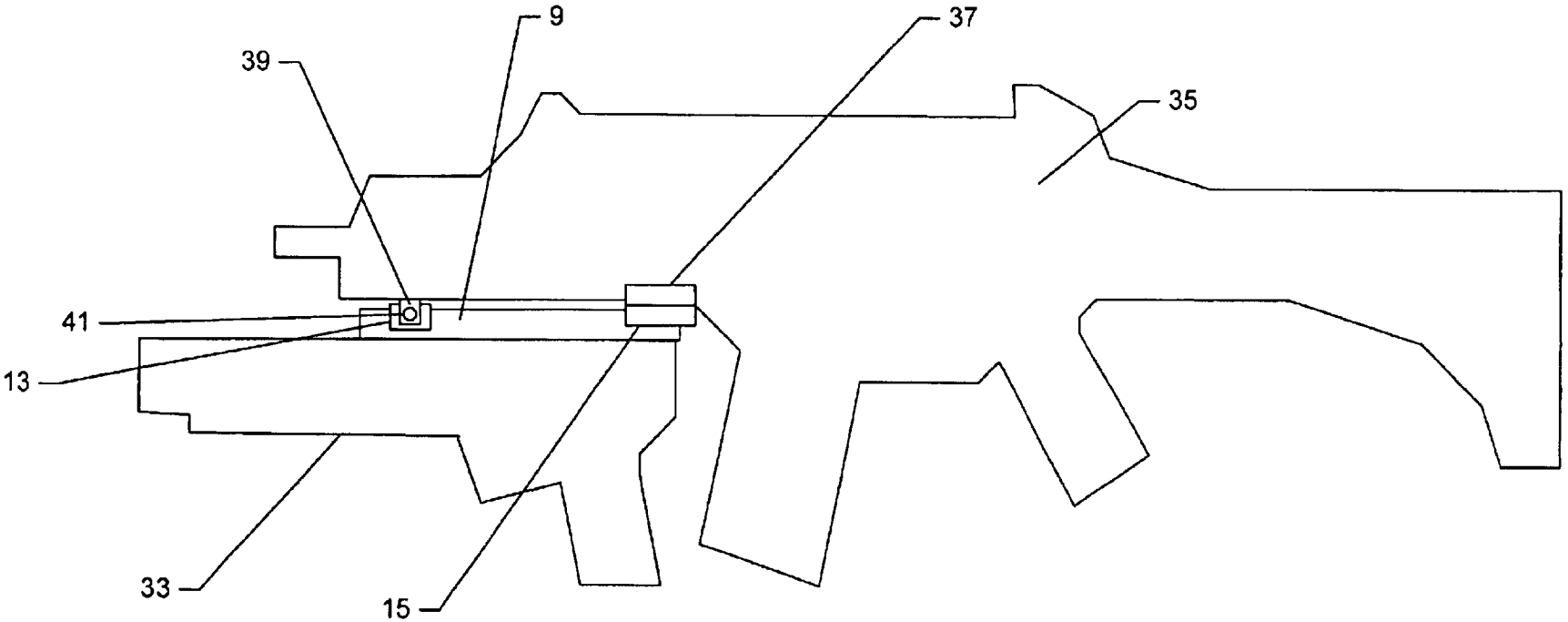
FIG. 7 illustrates a second example weapon system that includes a second example grenade launcher coupled to a second example firearm using a second example adapter disclosed herein.

From the foregoing, persons of ordinary skill in the art will readily appreciate that a weapon system, such as the weapon system shown in FIGS. 6–7, has been disclosed in which a grenade launcher 33 can be attached to different rapid firearms such as, for example the standard version and the short version of the M 16 discussed above. An example standard version 35' and a corresponding example short version 35 of an example firearm are shown in FIGS. 6 and 7, respectively. In the illustrated grenade launchers, the fit of the movable bearing (such as the movable bearings 37 and 37' corresponding to firearms 35 and 35', respectively) and the non-force-transferring coupling device 15, 15' is structured to accept high tolerances, so that the occurrence of an additional tolerance due to the adapter 9, 9' is insignificant. As a result, it is possible to removably attach the adapter 9, 9' to the grenade launcher 33 without a complex fitting. Additional, to a large extent inevitable, tolerances due to the removability of the adapter are easily absorbed by the movable bearing.

In the illustrated example, the force-transferring coupling device 13 is directly attached to the grenade launcher itself; not to the adapter 9, 9'. The coupling device 13 can be expediently used with weapons whose fixed bearings (such as the fixed bearings 39 and 39' and the associated safety lock pins 41 and 41' corresponding to firearms 35 and 35', respectively) are identically designed, but are mounted in different positions, as, for example, in the above-mentioned US M 16 A1 rifle and its short version. In addition, it is possible to removably and interchangeably attach the force-transferring coupling device 13 to the grenade launcher so that a specifically fit coupling device can be provided for each respective rifle model with which the grenade launcher is intended to be used. However, the fixed bearing should not be located too close to the reloading device of the rapid firearm.

An advantage of the illustrated device is that the adapter 9, 9' is not required to transmit recoil forces and can, therefore, be made from light alloy or plastic of lightweight construction. In addition, it is possible to attach the adapter 9, 9' with simple means.

In the examples of FIGS. 1–5, the grenade launchers are identical. Only the adapters 9, 9' and/or the force-transferring coupling devices 13 are different to accommodate attachment to firearms of different types.

In an alternative, the force-transferring coupling device 13 may be attached to the adapter 9, 9', for example, in the manner shown in FIG. 7. The adapter 9, 9' is then attached to the grenade launcher. In such an alternative, it is possible to attach the grenade launcher to a rapid firearm whose fixed bearing is located unusually far to the rear. For example, it is possible to attach the grenade launcher to a firearm having a so-called Bullpup design, for instance, the Austrian rifle AUG 77.

It is, however, preferred to firmly attach the force-transferring coupling device 13 directly to the grenade launcher (as shown in FIG. 6). In the preferred devices illustrated herein, the adapters 9, 9' include an even area parallel to the firing direction. This even area mounts on a complementary area of the grenade launcher. The adapter 9, 9' can be held there by a simple mounting device. The mounting device is preferably implemented by screws. The complementary surface of the grenade launcher can accept differently sized shoulder areas of diverse adapters without the need for any adaptations. Simple screws 23 or similar mounting devices are completely sufficient for mounting the adapter 9, 9' to the grenade launcher, as the adapter 9, 9' is not required to transfer recoil forces.

The housing 1 of the grenade launcher is preferably made of light alloy or reinforced plastic. The force-transferring coupling device 13 is preferably made of steel. The coupling device 13 includes a broad supporting surface which is embedded into the light alloy or the reinforced plastic of the grenade launcher housing 1. This results in a surface pressure on the material of the grenade launcher housing 1 which is far under its strength limit. The same applies also to the adapter 9, 9', if the coupling device 13 is attached to it.

As mentioned, the coupling device 13 may be removably attached to the grenade launcher housing 1 or to the adapter 9, 9'. Preferably, however, the coupling device 13 is formed as a composite casting together with the accepting part (i.e., the housing 1 or the adapter 9, 9').

The fixed bearing of the M 16 rifle is a hammer-head bolt that is complementary to the coupling device 13. In other words, the fixed bearing is a bolt which extends vertically with respect to the firing direction and exhibits a widened head. The widened head fits within an undercut groove 19 of the coupling device 13. A spring-secured cross pin secures the hammer-head bolt in the groove 19.

On the other hand, the movable bearing is preferably a simple groove which is open towards the front (i.e., in the direction of firing away from the shooter). A complementary rear end 15, 15' of the adapter 9, 9' is inserted into the open groove. The groove is deep enough to accept the rear end 15, 15' with tolerance.

The original front gunstock of the rapid firearm can still be used with the illustrated grenade launcher and adapters 9, 9'. A replacement of the front gunstock is not required. Alternatively, an adapted front gunstock can be used.

The illustrated grenade launcher is intended for attachment to a rapid firearm such as the M 16. However, it may alternatively be used as a separate weapon. When so used, the grenade launcher is shot like a pistol from the hand.

Figure 8:
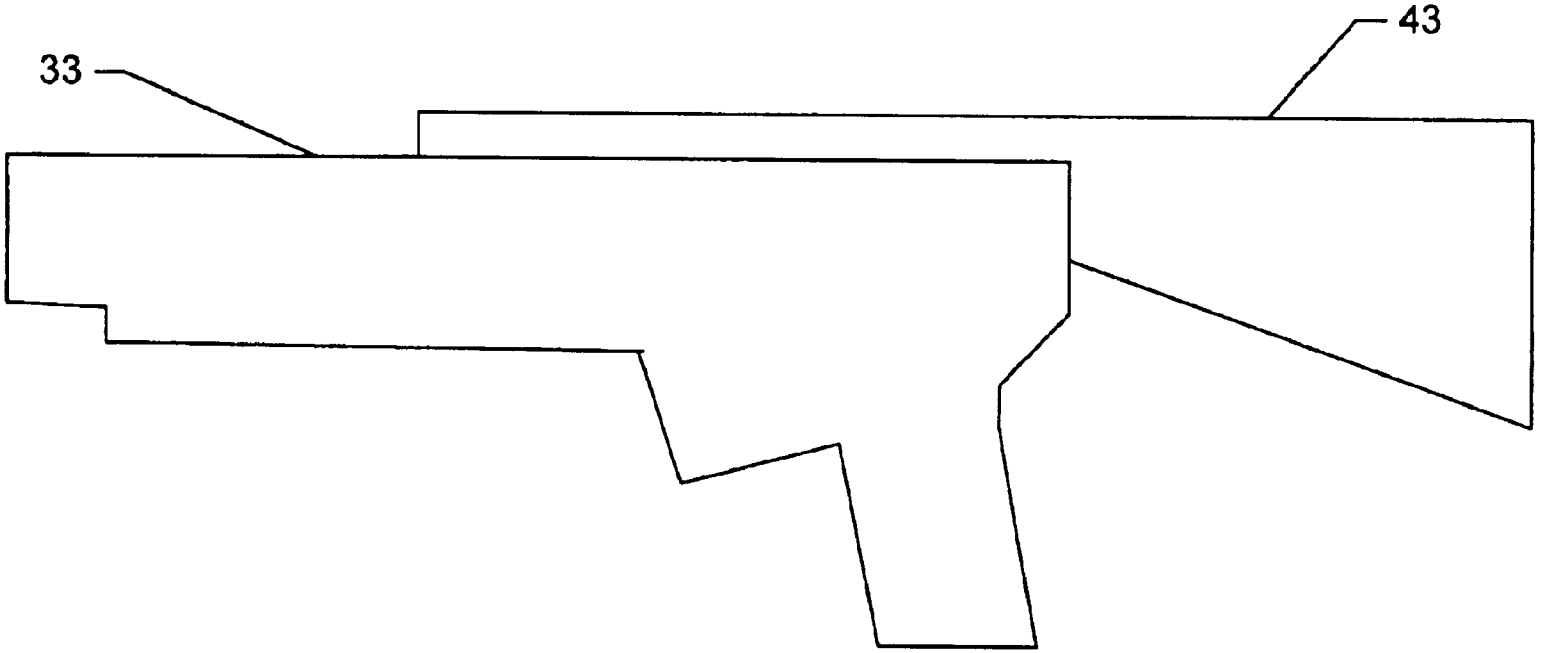
FIG. 8 illustrates an example stock coupled to an example grenade launcher.

In order to better bear the substantial recoil, a stock (shoulder rest) 43 is preferably provided, as shown in FIG. 8. The stock 43 can be attached to the grenade launcher 33 in place of the adapter 9, 9' when the grenade launcher 33 is intended to be used apart from another firearm. The stock (shoulder rest) 43 may be interchanged with the adapter 9, 9' whenever desired. The stock 41 may be manufactured from, for example, aluminum or plastic. In order to make replacement easy, the connection between the grenade launcher 33 and the adapters 9, 9' and/or the stock (shoulder rest) 43 may have the shape of a dovetail guide.

Although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. For use with a first firearm having a first fixed bearing and a first movable bearing, and a second firearm having a second fixed bearing and a second movable bearing, a grenade launcher comprising:

a housing;

a first coupling device positioned to engage at least one of the first fixed bearing and the second fixed bearing;

a first adapter to detachably mount to the housing and having a second coupling device positioned to engage the first movable bearing of the first firearm when the first adapter is mounted to the housing; and a second adapter to detachably mount to the housing and having a third coupling device positioned to engage the second movable bearing of the second firearm when the second adapter is mounted to the housing.

2. A grenade launcher as defined in claim 1 wherein, when the first adapter is mounted to the housing, the second coupling device is located a first distance from the first coupling device, when the second adapter is mounted to the housing, the third coupling device is located a second distance from the first coupling device, and the first distance is larger than the second distance.

3. A grenade launcher as defined in claim 1 further comprising a handle carried by the housing.

4. A grenade launcher as defined in claim 1 further comprising a sighting device carried by the housing.

5. A grenade launcher as defined in claim 1 wherein the first adapter includes a shoulder area positioned to engage a mounting surface of the housing.

6. A grenade launcher as defined in claim 5 wherein the second adapter includes a shoulder area positioned to engage a mounting surface of the housing.

7. A grenade launcher as defined in claim 1 further comprising fasteners to selectively secure one of the first and second adapters to the housing.

8. A grenade launcher as defined in claim 1 wherein the first coupling device is mounted on the housing.

9. A grenade launcher as defined in claim 1 wherein the first coupling device is mounted on the first adapter.

10. A grenade launcher as defined in claim 9 further comprising a fourth coupling device mounted on the second adapter and positioned to engage the second fixed bearing.

11. A grenade launcher as defined in claim 10 further comprising a pin to secure the second fixed bearing in a groove of the fourth coupling device.

12. A grenade launcher as defined in claim 1 wherein the first coupling device is mounted on the second adapter.

13. A grenade launcher as defined in claim 1 wherein the first coupling device defines a groove which is dimensioned to receive at least one of the first fixed bearing and the second fixed bearing.

14. A grenade launcher as defined in claim 1 further comprising a pin to secure at least one of the first fixed bearing and the second fixed bearing in the groove of the first coupling device.

15. A grenade launcher as defined in claim 1 wherein the second coupling device comprises a projection.

16. A grenade launcher as defined in claim 15 wherein the projection comprises a rearwardly directed fin.

17. A grenade launcher as defined in claim 1 further comprising a stock to detachably mount to the housing when neither the first adapter nor the second adapter is secured to the housing to adapt the grenade launcher for use apart from the first and second firearms.

* * * * *